United States Patent [19]

Mohr

[11] Patent Number: 4,672,985

[45] Date of Patent: Jun. 16, 1987

[54] BELT CLEANING APPARATUS

[76] Inventor: Larry D. Mohr, 5936 S. Dorsey La., Tempe, Ariz. 85282

[21] Appl. No.: 712,734

[22] Filed: Mar. 18, 1985

[51] Int. Cl.[4] ..... B08B 3/02

[52] U.S. Cl. ..... 134/57 R; 51/262 A; 134/107; 134/108; 134/111; 134/144

[58] Field of Search ..... 134/111, 122 R, 144, 134/172, 57 R, 104, 107, 108, 140, 153; 51/262 A

[56] References Cited

U.S. PATENT DOCUMENTS

| | | | |
|---|---|---|---|
| 1,413,060 | 4/1922 | Roberts | 51/262 A X |
| 2,549,070 | 4/1951 | Drews | 134/111 X |
| 2,567,589 | 9/1951 | Alvord | 51/262 A |
| 3,476,600 | 11/1969 | Morgan, Jr. et al. | 134/111 X |
| 3,812,622 | 5/1974 | Parsons | 51/262 A X |
| 3,847,753 | 11/1974 | Baird et al. | 134/172 X |
| 3,933,519 | 1/1976 | Koch et al. | 134/172 X |
| 4,226,548 | 10/1980 | Reith | 134/111 X |
| 4,543,182 | 9/1985 | Gramse et al. | 134/111 X |

FOREIGN PATENT DOCUMENTS

| | | | |
|---|---|---|---|
| 727406 | 4/1980 | U.S.S.R. | 51/262 A |

*Primary Examiner*—Philip R. Coe

*Attorney, Agent, or Firm*—Gregory J. Nelson

[57] ABSTRACT

A belt cleaning apparatus for cleaning continuous wide sanding belts which includes a belt drive assembly. The belt drive has a tensioning roller or bar which applies tension to the belt to be cleaned. A cleaning head with a spray nozzle reciprocates on a tracking lead screw to direct the spray against a belt surface as the belt rotates. Adjustable belt width sensing block cooperates with proximity switches on the cleaning head to conform travel to the belt width. Cleaning fluid is returned to a tank where the clogging material is allowed to either settle to accumulate on the fluid surface. Clarified solution is recycled and directed to the nozzle or returned to the tank via a heat exchanger unit.

6 Claims, 14 Drawing Figures

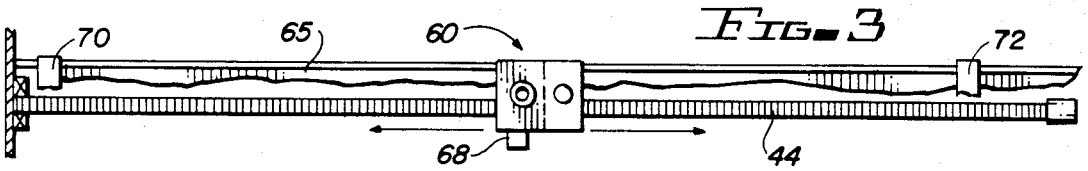
FIG. 3
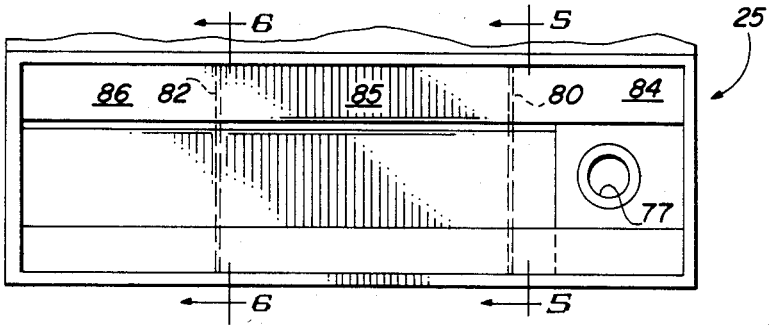
FIG. 4
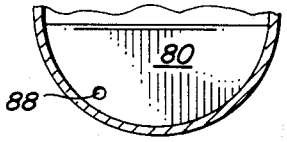
FIG. 5
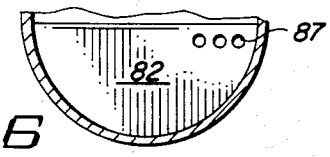
FIG. 6
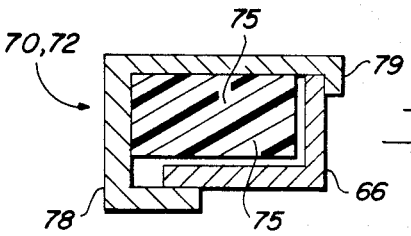
FIG. 9
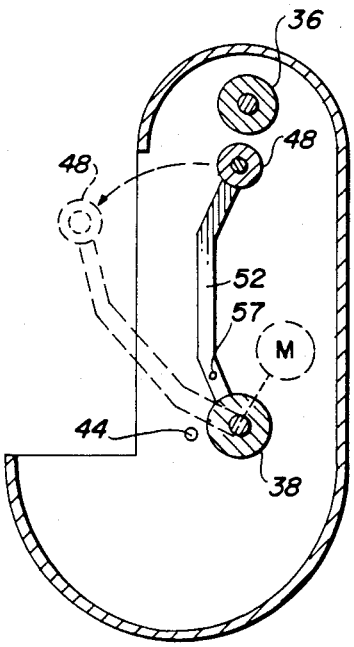
FIG. 7
FIG. 8
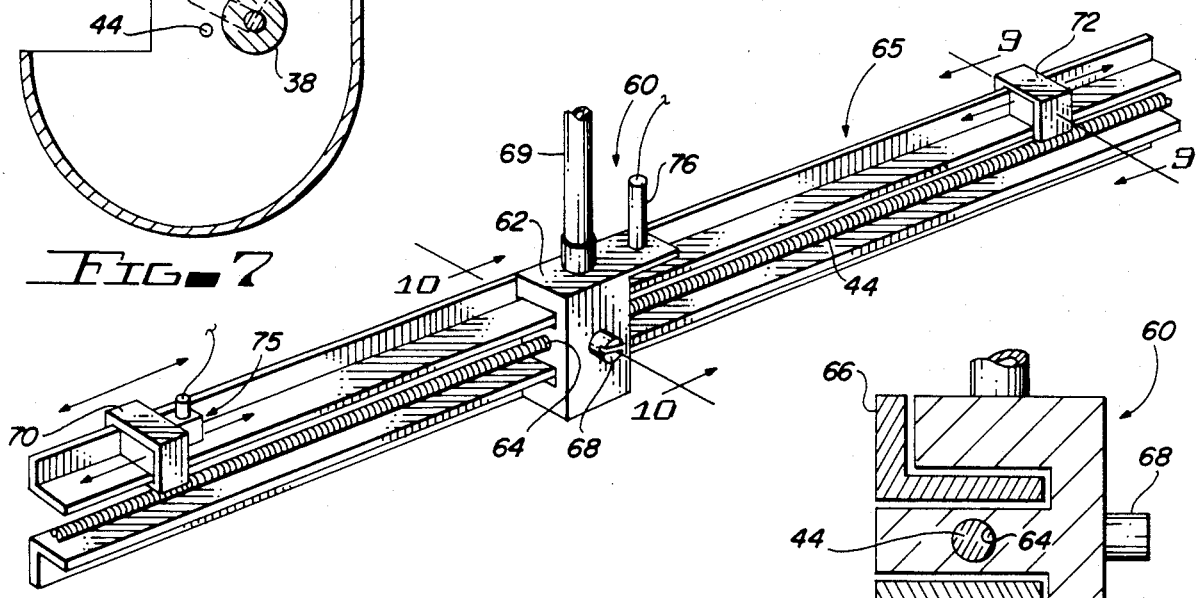
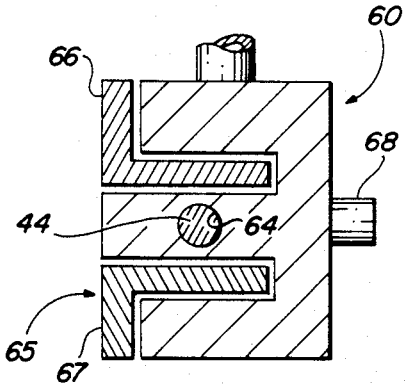
FIG. 10

BELT CLEANING APPARATUS

The present invention relates to a cleaning apparatus and more particularly relates to an apparatus for cleaning endless abrasive belts of the type typically used in the commercial woodworking and metalworking industry.

In the commercial woodworking industry and other industries, large endless abrasive belts are used for material removal. Generally these belts are provided in various lengths and widths with the abrasive material or grit being adhesively secured to a backing of cloth, paper, polyester or mylar. Once the grit becomes clogged with removed material, the belt loses its effectiveness and must be replaced. The removed belt many times is simply discarded. Attempts have been made in providing various devices and procedures for cleaning the belts, typically such prior art devices involve brushing of the belt coupled with immersion in a solvent bath. Typical systems of this type are the systems shown in U.S. Pat. No. 3,085,268.

Other prior art cleaning systems involve use of solvents sprayed onto a moving belt in conjunction with an air nozzle. The air nozzles are utilized to assist in grit removal and to drive the belt. Patents representative of these systems are U.S. Pat. Nos. 3,812,622 and 4,109,422.

These prior art systems have found limited acceptance in the industry due to various limitations. Some of the prior art systems are not effective for their intended purpose while others are complicated, expensive and require substantial operator attention. Accordingly, there exists a need in the industry for an effective and efficient apparatus for removing pitch and other material from clogged, endless abrasive belts.

Accordingly, it is a primary object of the present invention to provide a belt cleaning apparatus which is efficient and effective for removing pitch and material from clogged wide belts of various lengths and widths.

It is another object of the present invention to provide a belt cleaning apparatus which utilizes an automatic tracking spray system which insures quick, thorough cleaning of wide belts.

It is still another object of the present invention to provide a belt cleaning device which requires minimum operator attention and in which the belt may be easily loaded and unloaded.

Another object of the present invention is to provide a belt cleaning apparatus which uses a high pressure hot liquid cleaning system which has a holding tank for receiving and recycling the filtered cleaning liquid.

Briefly, the present invention comprehends a belt cleaning apparatus having a belt drive assembly which receives and rotates the belt to be cleaned. A tensioning roller applies tension to the belt. High pressure cleaning solution is directed by a reciprocating and tracking spray head against the exterior belt surface. The travel of the spray head is easily adjusted by means of a limit block which engages proximity switch sensers associated with the spray head. The cleaning fluid and materials fall on a splash guard and are directed to a subjacent baffled holding tank. The clogging material is removed from the cleaning fluid and sediment is trapped by a baffle arrangement which causes the solid to settle. Fluid is returned to the spray head or tank by a hydraulic circuit including heating elements. The device may include an auxilliary spray wand for other plant cleaning requirements.

The above and other objects and advantages of the present invention will become more apparent from the following description taken in conjunction with the drawings in which:

FIG. 3 is a detail view showing the cleaning jet and adjustable belt width sensing mechanism;

FIG. 4 is a top view of the holding tank for the cleaning fluid;

FIG. 5 is a sectional view taken along lines 5—5 of FIG. 4;

FIG. 6 is a detail view taken along lines 6—6 of FIG. 4;

FIG. 7 is a side view of the upper portion of the machine illustrating the belt tensioning mechanism; and FIG. 8 is a perspective view of the mechanism shown in FIG. 3;

FIG. 9 is a sectional view taken along lines 9—9 of FIG. 8;

FIG. 10 is a sectional view taken along lines 10—10 of FIG. 9;

Figure 1:
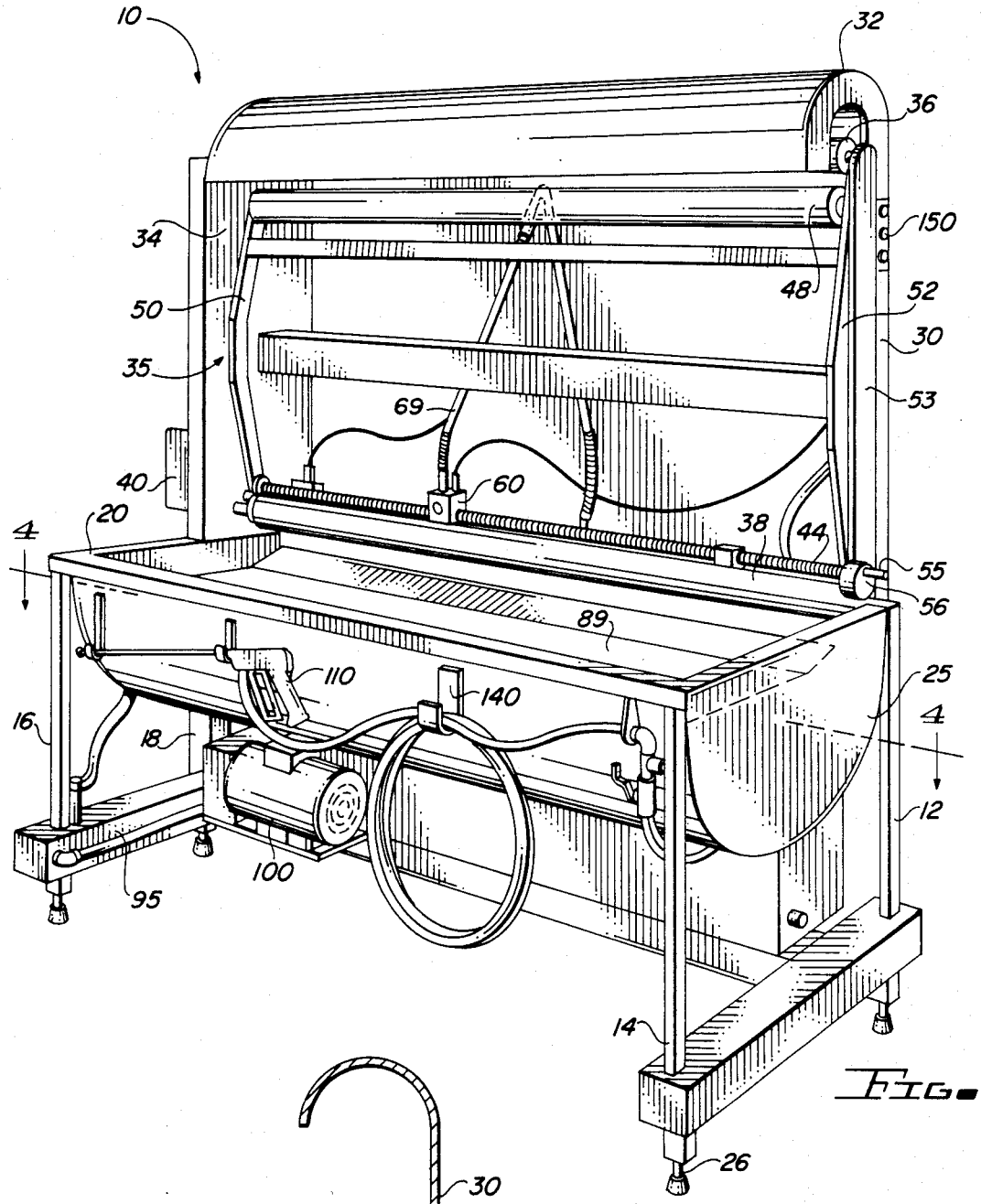
FIG. 1 is a front perspective view of the cleaning apparatus of the present invention.

Turning now to the drawings, the cleaning apparatus of the present invention is generally designated by the numeral 10 and includes a frame having upstanding legs 12 and 14 at one end, and legs 16 and 18 at the other end which support a generally rectangular frame 20 which is horizontally positioned at the upper end of the legs. Horizontal frame 20 supports tank 25 which has a generally U-shaped bottom. The lower end of legs 12, 14, 16 and 18 are provided with extendable levelers 26 which may vertically be adjusted to stabilize the cleaning assembly. The frame further includes upstanding backplate member 30 having a forwardly curved, semicircular shield 32 at its upper end. A side wall 34 extends vertically at the left end of the backplate as viewed in FIG. 1. The right side of the backplate, as viewed in FIG. 1, is open for loading and removal of the belt to be cleaned as will be more fully explained hereafter.

The belt assembly 35 is vertically positioned forward of the backplate and above tank 25. The belt drive 35 includes an upper idler roller 36 which extends horizontally within the shield 32. Idler 36 is appropriately mounted for rotation in pillow block bearings at vertical support bar 53. Drive roller 38 is horizontally positioned immediately above tank 25 and vertically spaced from idler roller 36. Drive roller 38 is mounted for rotation in suitable bearings and is driven by gear drive assembly 40 at the left end of roller 38, as best seen in FIG. 1, which includes a gear motor, chain and sprocket.

A tracking rod 44 extends horizontally above the belt drive roller. The tracking rod is provided with external threads and is bi-directionally driven by drive assembly 40. The belt assembly 35 further includes tension roller 48 which extends horizontally at a location intermediate the idler roller and the drive roller. The belt tension roller 48 is supported on arms 50 and 52 at its opposite ends. Arms 50 and 52 are pivotally mounted at their lower end to the frame. The tension roller may be locked in the vertical position at detent pin 55. Detent pin 55 is mounted in circular block 56 at the lower end of bar 53. As best seen in FIG. 1, detent pin 55 is engageable in a selected aperture 57 at the lower end of arm 52. When locking pin 55 is pulled out releasing the pin, the tension roller assembly pivots forward under the influence of gravity to hold a belt in position on the idler and drive rollers. Slight spring pressure may also be applied to pivot the roller, however, excessive tensioning force will tend to stretch and distort the belts.

Belt cleaning is effected at cleaning head 60 as best seen in FIGS. 1, 8 and 10. Cleaning head 60 includes a body 62 having an internally threaded bore 64 through which tracking rod 44 extends. It will be apparent that by rotating tracking rod 44 in one direction, the cleaning head will be caused to reciprocate in one direction along the rod and by reversing the rotational direction of rod 44, the cleaning head will be caused to reciprocate in the opposite direction. Guide 65 in the form of a pair of angles 66 and 67 extends transversely above the tracking rod and the horizontal legs of the guide engages slots in the cleaning head to guide its reciprocation. The head 60 is fabricated from a suitable plastic such as Teflon having low-frictional characteristics to facilitate tracking of the block along the guide 65.

Cleaning head 60 carries spray nozzle 68 which is oriented to direct the spray forwardly to impinge on the exterior rear surface of the belt being cleaned. The spray nozzle is connected to source of high pressure fluid by flexible conduit 69 and typically has a 40° fan spray pattern. The length of reciprocation of the cleaning head 60 is controlled by positioning proximity switch blocks 70 and 72 along guide 65. A first proximity block 70 is provided at one side of the cleaning head 60. A second proximity block 72 is provided at the block 60 side of head 60. Proximity switches 75, 76 are slidably mounted on opposite sides of the cleaning head 60 and, as seen in FIG. 9, comprises a rectangular block 75 of plastic such as HM plastic held in place on angle 66 by a ferrous clip 78 having a lip 79 engaging the vertical leg of angle 66. Switch 75 on block 70 and switch 76 on cleaning head 60 are actuated on contact to reverse the polarity of the drive motor, thus reversing the direction of travel to the cleaning head 60.

Upon actuation of the tracking bar 44, the rotation of the tracking bar will reciprocate the cleaning head 60 in a first direction until one of the switches 75, 76 is contacted. When this occurs, the cleaning cycle ends and the rotational direction of the tracking bar is reversed and the cleaning head is ready for a new cycle. By adjusting the relative position of the sensing blocks 70, 72 along the guide 65, the device can be easily adjusted to accept various belt widths. Switches 75 and 76 are connected in the circuit of motor 40 and upon actuation reverse motor polarity and operational direction. The details of the motor circuit are well known to those in the art. The speed of travel of the head 60 and the belt speed should be coordinated to insure complete coverage and avoid "barber-poling". Preferably, the belt should revolve approximately one revolution for every 2 inches of spray head travel.

An appropriate cleaning solution is contained in tank 25. Tank 25 is shown as being generally semi-circular in cross section having spaced apart transverse baffles 80, 82 dividing the tank into compartments 84, 85 and 86. Transverse baffle 80 is provided with an opening 88 at an intermediate elevation. Baffle 82 is provided with one or more openings 87 placing compartments 85 and 86 in fluid communication. Residue from the cleaning process is trapped at the surface of compartment 84 in foam or is retained as sediment in compartments 85 and 86. The sediment is periodically removed at drain 77. A removable splash tray 89 covers the tank and is sloped to direct all fluid and removed material to compartment 84.

Figure 2:
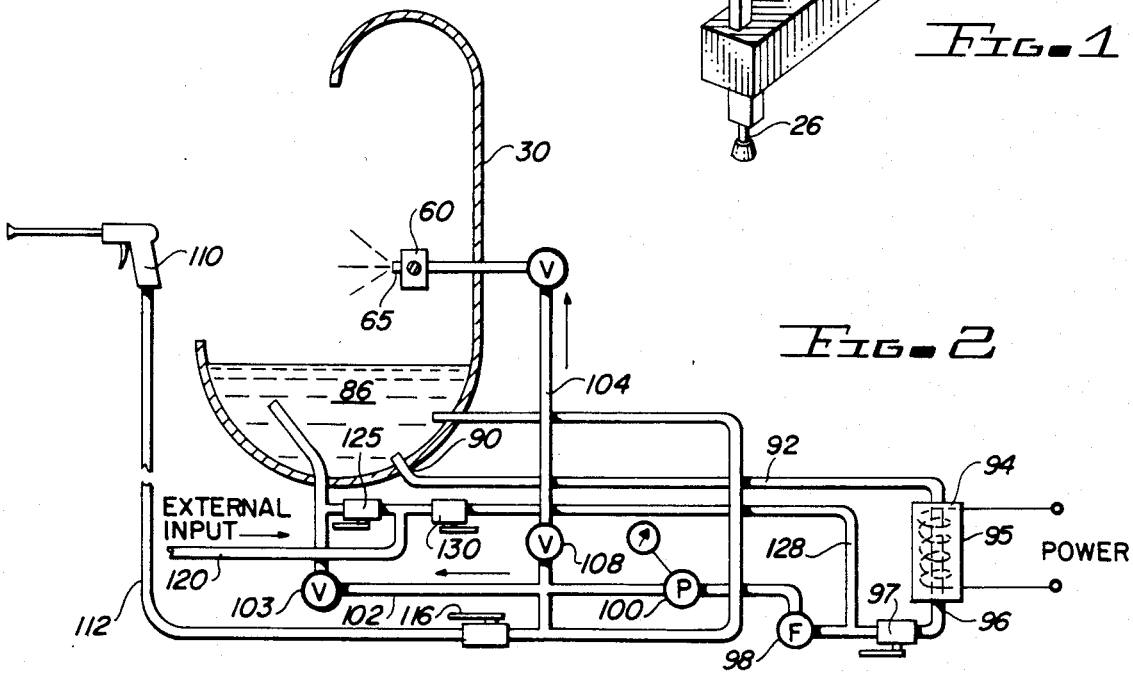
FIG. 2 is a schematic diagram showing the fluid flow system of the cleaning apparatus of the present invention.
Figure 11:
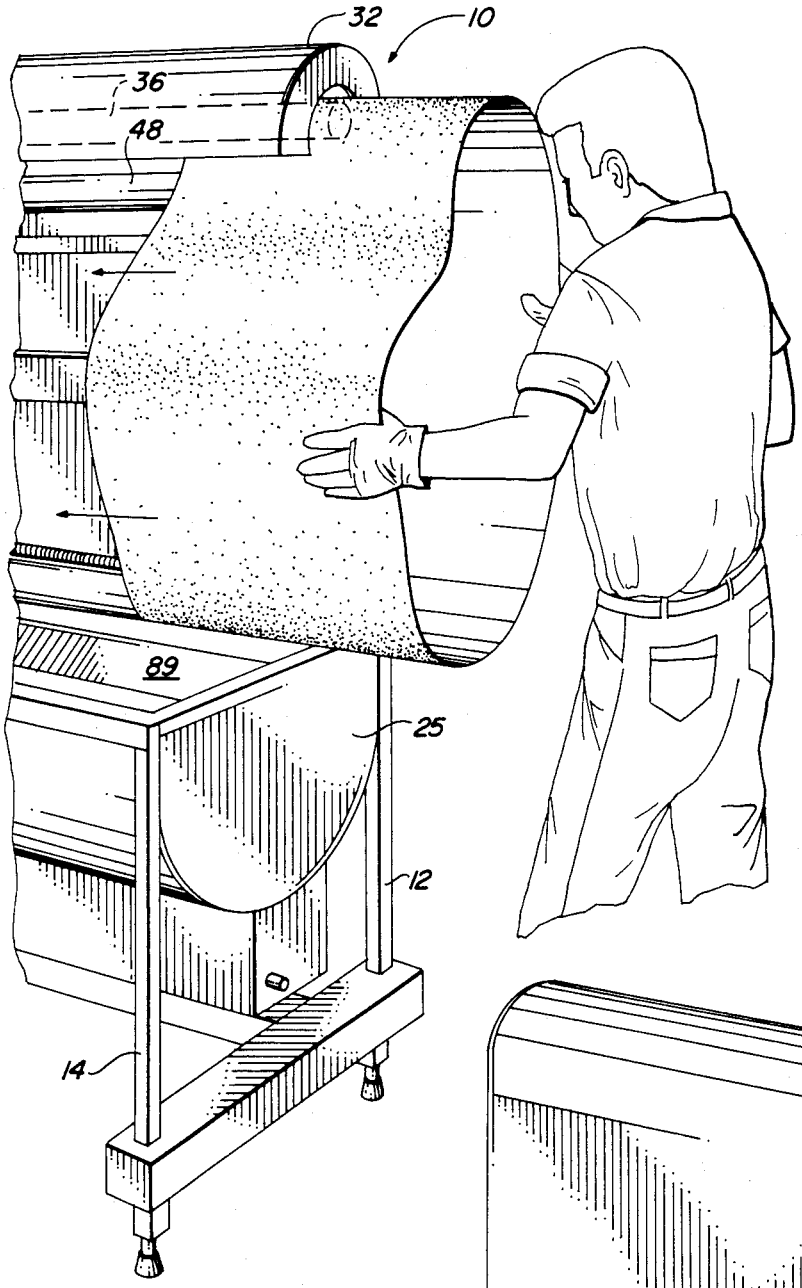
FIG. 11 shows a belt being loaded into the apparatus for cleaning.

As best seen in FIG. 2, the cleaning solution is recycled from compartment 86 via discharge line 90. Discharge 90 communicates with heating section 94 via conduit 92. Heating section 94 preferably includes two electrical resistance heating elements contained in housing 95 which for compactness is located between legs 16 and 18. During low-demand periods one of the heaters may be turned off. The heated fluid flows via conduit 96 across flow control valve 97 to filter 98 under the influence of high pressure pump 100. Pump 100 is typically rated at 1500 psi at a flow rate of 2.9 gpm. The discharge from pump 100 may be returned to tank 25 via line 102 under control of solenoid valve 103. Discharge from pump 100 may also be selectively directed via line 104 and solenoid valve 108 to cleaning head 60. When the spray nozzle is actuated, all the pump discharge is directed to the head 60. When the spray head is off, the fluid is recycled to the tank through the heater to maintain the fluid temperature.

A separate high pressure auxiliary spray wand 110 is also connected to pump 100 by conduit 112 across on/-off valve 116. Spray wand 110 may be used to clean the machine as well as other plant equipment. Fluid fill from an external source may be provided the system via inlet line 120 which may be introduced directly to the tank 25 across fluid flow valve 125 or alternatively may be directed to the inlet side of filter 98 by means of line 128 across flush valve 130. Accordingly, it will be obvious that by closing valve 97 and opening valve 130, flushing water from the external source can be directed across filter 98.

Figure 12:
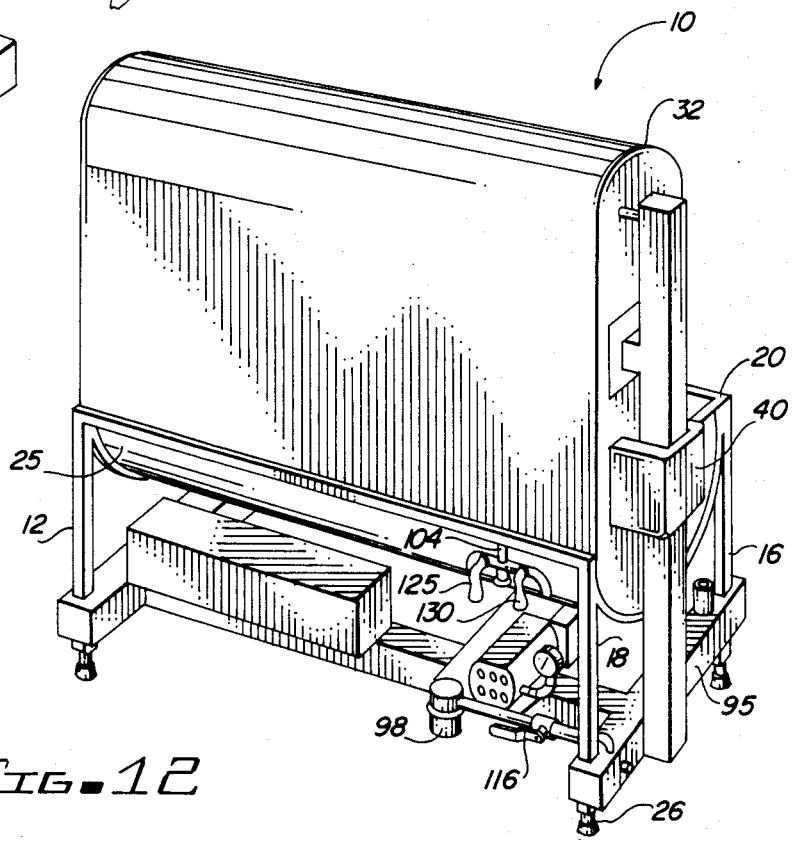
FIG. 12 is a rear perspective view of the cleaning apparatus of the present invention.

As best seen in FIG. 1, wand 110 may be conveniently positioned at hangers 140 at the front side of tank 25 and sufficient hose 112 is provided so that wand 110 can be used for auxiliary cleaning such as cleaning and degreasing plant machinery, engines, vehicles and work areas at remote locations. The pump 100, filter 98 and other associated valving and conduits are conveniently located on the frame with the major components conveniently located in an out-of-the-way position beneath the tank 25, as shown in FIG. 12. The details of the hydraulic connections and the electrical connections have not been shown in greater detail as the selection and installation of these components are well-known and will be apparent to those skilled in the art. Preferably, the control panel 150 is mounted at a convenient location such as at the side of the back panel 30 as shown in FIG. 1.

Figure 13:
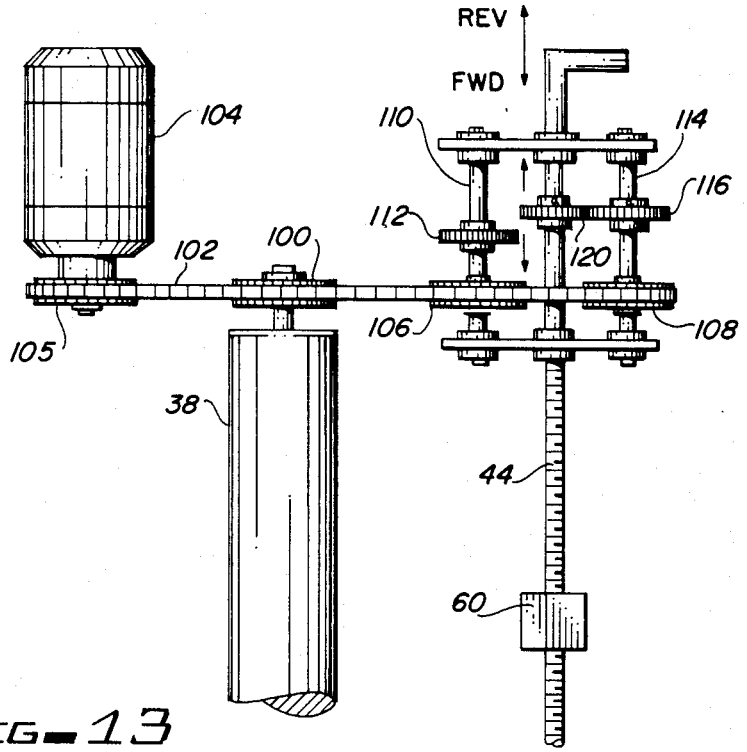
Figure 14:
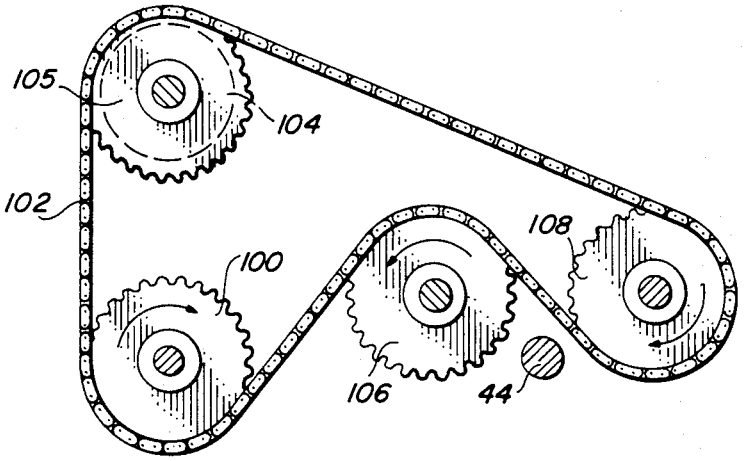

FIGS. 13 and 14 illustrate an alternate drive system for the drive roller 38 and tracking rod 44 which system is manually reversible. The drive roller 38 carries sprocket 100 which is driven through chain 102 by unidirectional motor 104 which carries sprocket 105 on its output shaft. Chain 102 extends around sprocket 100, over sprocket 106 and under sprocket 108. It will be seen the sprockets 106 and 108 are rotatively driven in opposite directions. Sprocket 106 is carried on shaft 110 on which is mounted gear 112. Chain sprocket 108 is carried on shaft 114 which also carries gear 116. Shafts 110 and 114 are parallel and gear 112 and 116 are spaced-apart and off-set from one another. Shaft 44 is axially slidable and carries gear 120. In one shaft position, gear 120 engages gear 112 and is driven in first rotational direction. In the other shaft position, gear 120 engages gear 116 and the shaft 44 is rotated in an opposite direction. Thus, the operator can easily and with facility change the direction of rotation of shaft 44 to reverse the travel of cleaning head 60 by simply adjusting the axial position of the shaft.

In operation, the holding tank 25 is charged with a suitable cleaning fluid. Preferably the cleaning fluid is a product similar to WBC-60 cleaning concentrate sold by Abrasive Belt Master of Phoenix, Ariz. This is an alkaline bio-degradable cleaner which serves as a solvent, penetrant, detergent, as well as a setting and emulsifying agent. When a belt such as a belt used in the woodworking industry becomes clogged, it is removed from the sanding apparatus and placed in the cleaning apparatus 10. This is easily accomplished by simply sliding the belt over the idler roller 36 and the drive roller 38 from the right side of the machine as shown in FIG. 10. The tensioning roller 48 is locked in a vertical position by locking detent 55. When the belt is fully engaged on the rollers and is positioned to the far left, the detent lock 55 is released and the tensioning roller will fall forward engaging the inner surface of the endless belt to place the proper tension on the belt to accomodate a range of belt sizes.

The user then positions the proximity sensing blocks 70 and 72 to align with the opposite side edges of the belt to be cleaned. Generally, only block 72 will have to be adjusted. The pump 100 is actuated at control 150 along with the drive motor 40. Rotation of the tracking bar 44 will cause the cleaning head 60 to travel across the width of the belt as the belt is caused to rotate by rotation of roller 38. The high pressure jet 65 carried on the cleaning head 60 will, under the influence of pump 100, deliver a stream of hot, high-pressure cleaning fluid against the exterior surface of the belt to clean the belt and remove pitch and clogging materials. The removed material and fluid will fall on the cover 89 and flow to the tank compartment 84 where most of the solids will be maintained in suspension at the upper surface of the liquid level or will settle in compartments 84 and 85. Recycled fluid flows through passage 88 to adjacent compartment 85 subsequently to compartment 86 which is connected to the pump inlet. Heating of the fluid at electric heating elements 94 increases the effectiveness of the cleaning operation. Periodically, tank cover 89 can be removed for cleaning the tank. Additionally, as seen in FIG. 2, the filter 98 can be periodically flushed with clean water from an external source.

Accordingly, it will be seen the present invention provides an effective and efficient apparatus for removing material from clogged abrasive belts. The apparatus is designed to operate with a minimum of operator attention and the cleaning cycle is automatically controlled. Belts once cleaned, can be suitably air dried and may be re-used a number of times effecting a substantial savings to the shop operator. Cleaning fluid is recycled for efficiency and the system has a self-contained filtering system.

It will be obvious to those skilled in the art to make various modifications, alterations and changes to the belt cleaning apparatus of the present invention. To the extent such changes, alterations and modifications do not depart from the spirit and scope of the appended claims, they are intended to be encompassed therein.

I claim:

1. A belt cleaning apparatus for cleaning material from a surface of continuous wide sanding belts of various sizes independent of the sanding apparatus comprising:

(a) a belt drive assembly for receiving the wide belts, said belt drive assembly including drive means for rotating said belts for a predetermined time period;

(b) spray means adapted to reciprocate across a belt surface and to direct a spray of high pressure fluid toward the said surface, said spray means including sensing means for controlling the reciprocation of the spray means;

(c) tank means positioned subjacent said spray means adapted to receive the sprayed fluid and material discharged from the belt, said tank means including means for separating the removed material from the fluid and means for recycling the fluid to said spray head; and (d) tensioning means associated with said belt drive assembly for tensioning said belt on said drive means whereby belts of various sizes may be accomodated thereon.

2. The belt cleaning apparatus of claim 1 further including heating means in the recycle means.

3. The belt cleaning apparatus of claim 1 wherein said tank means comprises a plurality of compartments in hydraulic communication.

4. The belt cleaning apparatus of claim 1 further including auxiliary spray wand means operatively connected to said recycle circuit.

5. The belt drive assembly of claim 1 wherein said spray means comprises a cleaning head including a spray nozzle, said spray head being in threaded engagement with a transversely extending lead screw operatively driven by motor means.

6. The belt cleaning apparatus of claim 5 wherein said cleaning head includes proximity switch means and further including adjustable belt width sensing block means whereby the travel of the spray head is established by selective positioning of said sensing block means.

* * * * *